United States Patent [19]

Erasov

[11] Patent Number: 4,657,494

[45] Date of Patent: Apr. 14, 1987

[54] PLANETARY-ROTOR HYDRAULIC MOTOR WITH REVERSING MECHANISM

[75] Inventor: Fedor N. Erasov, Odessa, U.S.S.R.

[73] Assignee: Zaporozhsky Konstruktorsky Tekhnologichesky Institut Selskokhozyaistvennogo Mashinostroenia, Zaporozhie, U.S.S.R.

[21] Appl. No.: 758,452

[22] Filed: Jul. 24, 1985

[51] Int. Cl.[4] ..... F03C 2/08

[52] U.S. Cl. ..... 418/61 B

[58] Field of Search ..... 418/61 B

[56] References Cited

U.S. PATENT DOCUMENTS

| | | | |
|---|---|---|---|
| Re. 28,051 | 6/1974 | McDermott | 418/61 B |
| 4,264,288 | 4/1981 | Wusthof et al. | 418/61 B |
| 4,380,420 | 4/1983 | Wusthof et al. | 418/61 B |
| 4,462,773 | 7/1984 | Erasov et al. | 418/61 B |
| 4,484,870 | 11/1984 | Erasov | 418/61 B |

FOREIGN PATENT DOCUMENTS

| | | | |
|---|---|---|---|
| 1028891 | 7/1983 | U.S.S.R. | 418/61 B |
| 1070337 | 1/1984 | U.S.S.R. . | |
| 1130696 | 12/1984 | U.S.S.R. | 418/61 B |

*Primary Examiner*—John J. Vrablik

*Attorney, Agent, or Firm*—Lilling & Greenspan

[57] ABSTRACT

A planetary-rotor hydraulic motor in a housing enclosed on two sides by first and second cover plates, of which there is disposed a shaft carrying a gear fixedly secured thereon and engageable with an inner toothing of a rotor arranged with an eccentricity relative to the shaft to form variable volume chambers, an outer toothing of the rotor engaging with an inner toothing of the housing and a fluid distributor serving to alternately communicate the variable volume chambers with holes in the second cover plate for feeding and discharging a fluid through a control valve accommodated in the second cover plate and resiliently urged to the fluid distributor, the control valve defining by its side opposite to the one facing the fluid distributor with the second cover plate a cavity continuously communicating through a damping passage with the hole for feeding the fluid. Further provided in the hydraulic motor are a reversing mechanism which comprises a toothed rack received by a drilling made in the second cover plate and having at rack ends pistons which form piston spaces in the drilling, a toothed sector made on the periphery of the control valve to engage with the toothed rack, and a solenoid-operated fluid distributor secured on the second cover plate communicating in its neutral position with the hole for feeding the fluid and continuously communicating with the cavity formed between the control valve and the second cover plate for periodically connecting therewith the piston spaces to adjust the toothed rack and turn the control valve relative to the second cover plate.

2 Claims, 4 Drawing Figures

PLANETARY-ROTOR HYDRAULIC MOTOR WITH REVERSING MECHANISM

BACKGROUND OF THE INVENTION

This invention relates generally to positive displacement hydraulic machines, and more particularly to planetary-rotor hydraulic motors.

The planetary-rotor hydraulic motor according to the present invention can find application in farm machinery for driving a range of agricultural implements.

The hydraulic motor proposed by the invention can also be used in aviation, heavy machine production and shipbuilding as a gearless drive of actuating mechanisms. It can be built into a vehicle wheel, into a winch drum, etc.

DESCRIPTION OF THE PRIOR ART

There is known a planetary-rotor hydraulic motor comprising a housing enclosed on two sides by cover caps. One cover cap serves for mounting the hydraulic motor, whereas the other has holes for feeding and discharging a hydraulic fluid. The housing accommodates a shaft having a gear secured thereon and a ring motor arranged with an eccentricity relative to the shaft and having two toothings. The inner toothing of the rotor engages with the shaft gear to form therewith chambers of variable volume. The outer toothing of the rotor engages with the inner toothing of the housing. Adjoining the rotor on the shaft is a fluid distributor having passages for feeding and discharging the fluid from ports provided in the fluid distributor on the side thereof facing the second cover cap to the chambers of variable volume. On the opposite side of the rotor the variable chambers are confined by a wear plate secured on the shaft. Disposed in the second cover cap is a control valve resiliently urged to the fluid distributor and capable of axial movement under the action of the fluid pressure. Ports are provided on the side of the control valve facing the fluid distributor, some of these ports communicating by passages with the hole in the second cover cap for feeding the fluid, whereas others communicate by passages with the hole in the second cover cap for discharging the fluid. On its side opposite to one facing the fluid distributor the control valve defines with the second cover cap a cavity continuously communicating through a damping passage with the hole for feeding the fluid in the second cover cap. Fluid occupying this cavity produces a force acting to press the control valve to the surface of the fluid distributor.

For reversing the rotation of the shaft the hydraulic motor has a reversing mechanism comprising a nipple connected to the control valve to adjustably move this valve relative to the second cover cap. A lever rigidly connected to the nipple serves for turning the nipple with the control valve. The second cover cap and nipple have passages to communicate in the neutral position of the control valve, and consequently of the nipple, the cavity between the control valve and the second cover cap with the hole for discharging the fluid. When the nipple, and consequently the control valve, are turned, these passages discommunicate, whereby fluid pressure in the cavity between the control valve and second cover cap equalizes with the pressure in the hole for feeding the fluid for the fluid to flow through the control valve and fluid distributor to the variable volume chambers.

Depending on which side the control valve is turned, the rotation of the shaft is changed, and in this manner reversal of shaft rotation is effected (cf., USSR Inventor's Certificate No. 1,070,337, or U.S. Pat. No. 4,484,870).

In the aforedescribed prior art hydraulic motor the angular displacement of the control valve is done by manually turning the nipple by the lever. When hydraulic motors are built into farm vehicle wheels or trailed farm implements, they must be controlled from the driver's cabin through a system of mechanical linkages or rods, which is disadvantageous because of delayed response for reversal, insufficient reliability and overcomplicated construction of the kinematic chain.

SUMMARY OF THE INVENTION

It is an object of the present invention to shorten the response of the shaft reversing mechanism of a planetary-rotor hydraulic motor.

Another object is to the make the hydraulic motor more reliable in operation.

One more object is to ensure that reversal of the hydraulic motor can be done by remote control.

These and other objects and attending advantages are attained by a planetary-rotor hydraulic motor in a housing of which, enclosed on both sides by first and second cover plates, there is disposed a shaft having secured thereon a gear engageable with an inner toothing of a rotor arranged with an eccentricity relative to the shaft to define chambers of variable volume, an outer toothing of the rotor engaging with an inner toothing provided on the inside of the housing and a fluid distributor alternately communicating the variable volume chambers with holes made in the second cover plate for feeding and discharging the fluid through a control valve disposed in this cover plate and resiliently urged to the fluid distributor, this control valve defining by its side opposite to the side facing the fluid distributor with the second cover plate a cavity continuously communicating through a damping passage with the hole for feeding the fluid, a reversing mechanism being further provided for adjustably turning the control valve relative to the second cover plate, according to the invention, the reversing mechanism includes a toothed rack received by a drilling made in the second cover plate and having at its ends pistons to form piston spaces in the drilling, a toothed sector made on the periphery of the control valve and engageable with the toothed rack, and a solenoid-operated fluid distributor secured on the second cover plate and continuously communicating with the cavity between the control valve and second cover plate to periodically connect therewith the piston spaces for adjustably moving the toothed rack and thus turning the control valve relative to the second cover plate.

Preferably, the second cover plate is provided with a passage communicating the cavity between the control valve and second cover plate with the hole for discharging the fluid, a non-return valve openable in response to an increase in the pressure of fluid in the cavity between the control valve and second cover plate being accommodated in this passage.

The provision of the non-return valve in the planetary-rotor hydraulic motor equipped with a built-in reversing mechanism described above makes it possible to ensure the travel of hydraulic fluid in an invariable direction both during operation of the hydraulic motor and when it is stopped under overload. This decreases to a considerable degree delays in the response of the non-return valve and reduces its time constant, which enables to substantially reduce peak pressures accompanying reversals and overloads to result in a more reliable operation of the planetary-rotor hydraulic motor.

The hydraulic motor according to the invention is simple to construct and allows, thanks to reducing the time of response of the reversing mechanism, to improve the reliability of the motor in operation. In addition, the proposed hydraulic motor enables to considerably simplify the hydraulic system of a machine in which it is used and consequently to expand the range of its application.

BRIEF DESCRIPTION OF THE DRAWINGS

The invention will now be described in greater detail with reference to a preferred embodiment thereof taken in conjunction with the accompanying drawings, in which.

DESCRIPTION OF A PREFERRED EMBODIMENT

Figure 1:
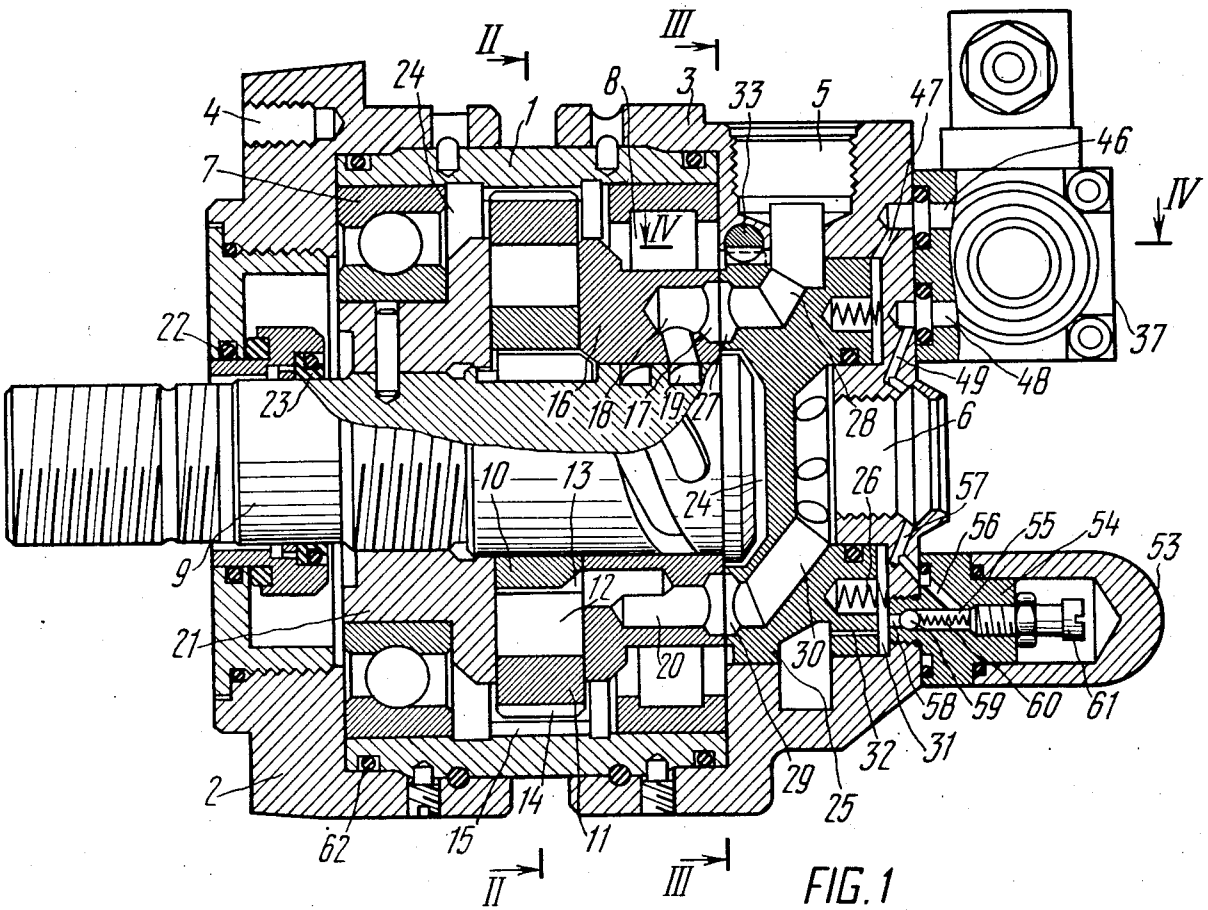
FIG. 1 is a longitudinal sectional view of a planetary-rotor hydraulic motor according to the invention.

A planetary-rotor hydraulic motor hereinafter referred to as simply hydraulic motor comprises a housing 1 (FIG. 1) enclosed at one end by a first cover plate 2 and at the opposite end by a second cover plate 3.

Threaded holes 4 are provided in the cover plate 2 for mounting the hydraulic motor.

The second cover plate 3 has a hole 5 for feeding a hydraulic fluid from a pump (not shown) and a hole 6 for discharging the fluid. Secured in bearings 7 and 8 inside the housing 1 is a shaft 9 carrying a gear 10. Arranged eccentrically on the shaft 9 inside the housing 1 is a rotor having an inner toothing 12 engageable with the gear 10 to form chambers 13 (FIG. 2) of variable volume. An outer toothing 14 of the rotor 11 engages with an inner toothing 15 provided in the housing 1 to function as a stator gear. Secured on the shaft 9 at the side the second cover plate 3 (FIG. 1) is a fluid distributor 16 on which the bearing 8 is mounted, this fluid distributor 16 being capable of joint rotation with the shaft 9. At the side facing the second cover plate 3 the distributor 16 is provided with ports 17, some of which ports 17 communicate by passages 18 made in the fluid distributor 16 and passages 19 made in the shaft 9 with the variable volume chambers 13, whereas other ports communicate with the variable volume chambers 13 through pasasges 20 also provided in the fluid distributor 16. The chamber 13 of variable volume are confined at the opposite side by a wear plate 21 rigidly connected to the shaft 9. The bearing 7 is mounted on this wear plate 21. The cover plate 2 accommodates sealing elements 22 and 23 to make interior 24 defined in the housing 1 pressure tight.

Figure 3:
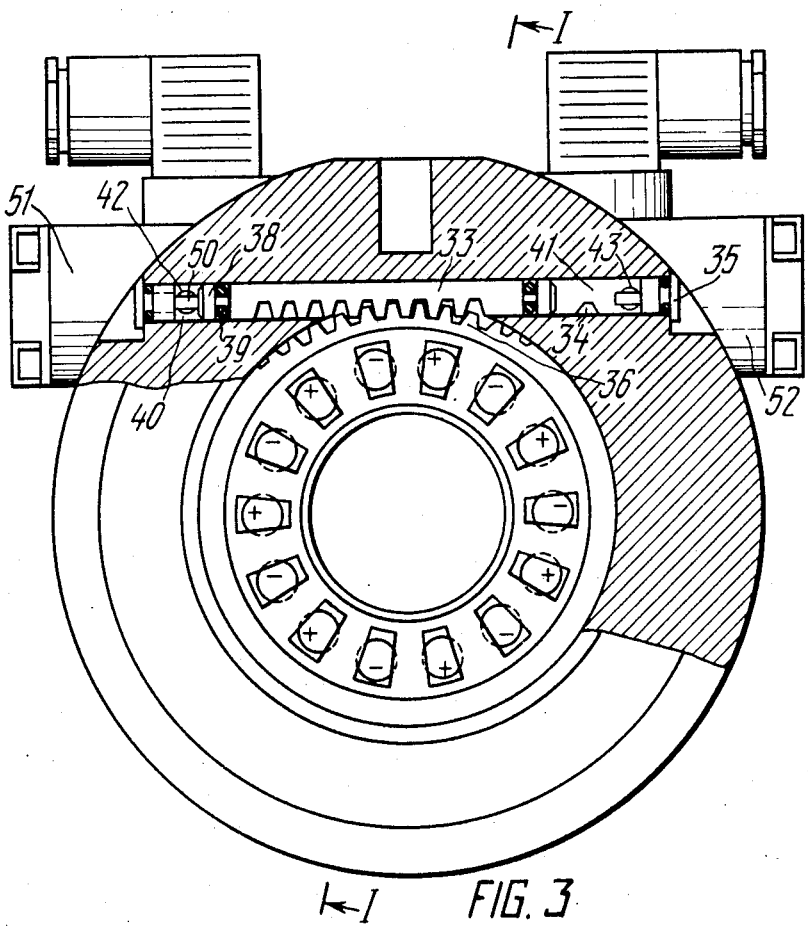
FIG. 3 is a section taken on line III—III in FIG. 1.

The second cover plate 3 accommodates an axially movable control valve 25. By means of springs 26 arranged equidistantly about its circumference the control valve 25 is continuously urged to the end face of the fluid distributor 16. At the side of the control valve 25 facing the fluid distributor 16 there are provided valving ports 27 communicable by a passage 23 with the hole 5 for feeding the fluid and ports 29 communicable by way of a passage 30 with the hole 6 for discharging the fluid. The ports 27 for feeding the fluid are indicated in FIG. 3 by (+), whereas the ports 29 are indicated by (−).

The control valve 25 is so arranged in the second cover plate 3 that an annular cavity 31 is formed between the control valve and cover plate communicating through a damping passage 32 with a hole 5 to be filled with the fluid and produce a force making it possible to urge the control valve 25 to the fluid distributor 16.

The second cover plate 3 also accommodates a reversing mechanism comprising: a toothed rack 33 (FIGS. 3 and 4) received by a drilling or bore 34 made in the cover plate 3 and enclosed on the opposite sides by plugs 35; a toothed sector 36 provided about the periphery of the control valve 25 and engageable with the toothed rack 33; and a solenoid-controlled three-position fluid distributor 37 (FIG. 4) secured on the second cover plate 3.

The toothed rack 33 has at its ends pistons 38 made pressure-tight by means of seals 39. Piston spaces 40 and 41 are defined between the pistons 38 and the second cover plate 3 in the drilling or cylinder bore 34, these spaces communicating by way of passages 42 (FIG. 4) and 43, respectively, with hollows 44 and 45 of the fluid distributor 37. A pressure cavity 46 (FIG. 1) of the fluid distributor 37 communicates by way of a passage 47 with the cavity 31 between the control valve 25 and second cover plate 3, whereas a cavity 48 of the fluid distributor 37 communicates by way of a passage 49 with the hole 6 for discharging the fluid from the hydraulic motor.

The toothed rack 33 is capable of traveling a distance substantially equal to $\pi D/n$ , where D is the initial diameter of the toothed sector 36 of the control valve 25; and n is the total number or ports 27 and 29 of the control valve 25.

Stops 50 (FIGS. 3 and 4) are provided on the plugs 35 for limiting the travel of the toothed rack 33.

The fluid distributor 37 has solenoids 51 and 52.

The fluid distributor 37 and solenoids 51 and 52 are of any known suitable construction and therefore are not discussed in the present description.

Figure 2:
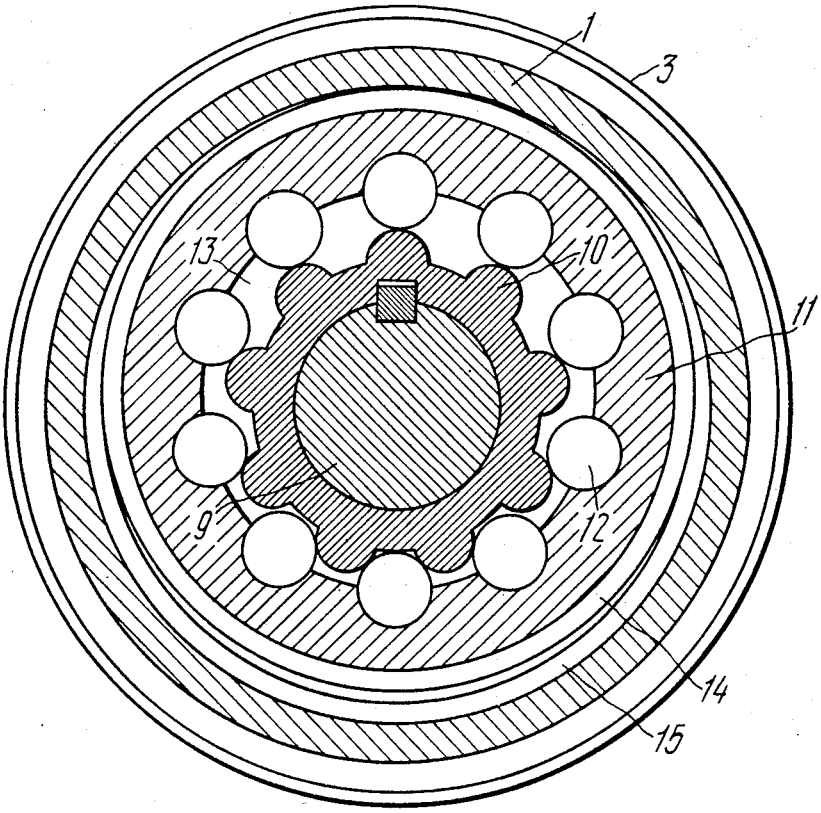
FIG. 2 is a section taken on line II—II in FIG. 1.
Figure 4:
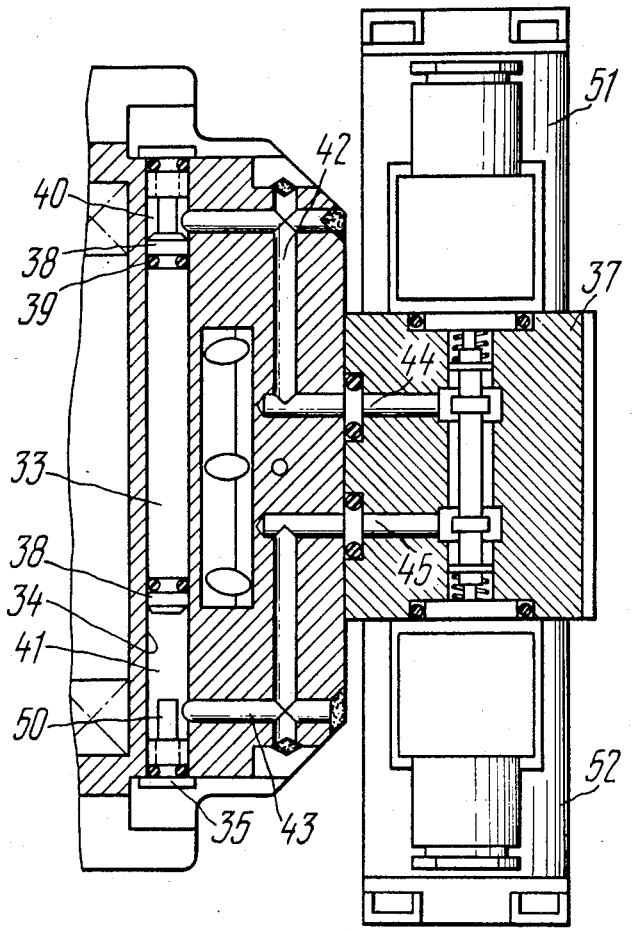
FIG. 4 is a section taken on line IV—IV in FIG. 1.

Referring to FIGS. 1 and 4, there is illustrated, only by way of example, a three-position distributor with electromagnetic control which has passages or cavities 44, 45, 46 and 48 and electromagnets or solenoids 51 and 52 as above noted. The liquid from the passage 46 is passed to a discharging hole 6, when exitation has been removed from the electromagnets, through the distributor 37 in which all the passages 44, 45, 46 and 48 communicate with each other. The slide valve of the distributor is in the middle position, as shown in the figure. When the electromagnet 51 is excited, the passage 46 is placed into fluid flow communication with the passage 45 and the passage 48 in fluid flow communication with the passage 44. When the electromagnet 52 is excited, the passage 48 is placed in fluid flow communication with the passage 45 and the passage 46 in fluid flow communication with the passage 44.

The fluid from the control valve 25 is fed to the ports 17 of the distributor 16. Some of the ports 17 communicate with the variable volume chambers 13 through passages 20 provided in the fluid distributor 16, whereas other ports 17 communicate with the variable volume chambers 13 through the passages 18 made in the fluid distributor 16 and through passages 19 made in the shaft 9. The passages 19 are made in the shaft 9 along a helical line as shown in FIG. 1. Such a fluid distribution has been described in Inventor's Certificate Specification No. 1130696, issued in the U.S.S.R. in the name of Erasov, F.N.

In order to protect the hydraulic motor from possible overloads, there is provided a non-return valve 53 (FIG. 1) comprising a housing 54 secured on the second cover plate 3. The housing 54 has a hole 55 communicable by a passage 56 provided in the housing 54 and a passage 57 made in the cover plate 3 with the discharge hole 6. The housing 54 has a passage 58 extending by one end toward the cavity 31 between the control valve 25 and cover plate 3 and by the other end extending toward the hole 55. The passage 58 is closed by a stop element 59 of the non-return valve 53. The stop element 59 is continuously spring-biased by a spring 60 occupying the hole 55. The spring force is adjusted by a screw 61. The passage 58 has a diameter somewhat less than the diameter of the hole 55. The provision of the non-return valve 53 immediately on the cover plate of the hydraulic motor having a built-in reversing mechanism ensures reduction of pressure peaks when the motor is reversed under maximum load.

The housing 1 and cover plates 2 and 3 are pressure-sealed by seals 62.

The planetary-rotor hydraulic motor according to the invention operates in the following manner.

When the working fluid is supplied from a hydraulic pump (not shown) to the hole 5 provided in the second cover plate 3, with the solenoids 51 and 52 of the fluid distributor 37 being deenergized, this fluid is admitted to the passages 28 to flow through the damping passage 32 to the annular cavity 31 between the control valve 25 and the cover plate 3. From this cavity the fluid tends to flow along the passage 47 to the pressure cavity 46 of the fluid distributor 37. In consequence, because the solenoids 51 and 52 are deenergized, the fluid is delivered from the cavity 46 to the hole 6 for discharge. A pressure is established in the cavity 31 substantially lower than in the passages 28 and in the interior 24. Therefore, due to a small pressure differential the control valve 25 is caused to be forced away from the fluid disitributor 16, whereby the fluid admitted from the passages 28 to the ports 27 of the control valve 25 flows through a clearance formed between the fluid distributor 16 and control valve 25 to the ports 29 of the control valve 25 and further along the passages 30 to the hole 6 in the cover cap 3 for discharge. In this manner, with the control valve 25 forced away from the fluid distributor 16, the hydraulic motor is relieved from the pressure of fluid.

On energizing the solenoid 51 of the fluid distributor 37 the cavity 31 discommunicates from the cavity 48 whereby fluid discharge is prevented.

The fluid conveyed from the cavity 31 to cavity 46 is admitted to the cavity 45 to be further conveyed along the passage 43 to the piston space 41 and move the toothed rack 33 to the left up to the stop 50 (FIG. 3). The travel of the toothed rack 33 equals a distance $\pi D/n$, the control valve 25 turning an angle $2\pi/n$, where n is the total number of ports 27 and 29 of the control valve 25. The pressure of fluid in the cavity 31, passages 28 and in the interior 24 equalizes. The control valve 25 is forced by the springs 26 to the fluid distributor 16. The fluid is therefore caused to flow through the passages 28, ports 27 of the control valve 25, ports 17 of the fluid distributor 16 communicating with the ports 27 and passages 18, 19 and 20 of the fluid distributor 16 to one half of the variable volume chambers 13. Under the action of fluid pressure in one half of the chambers 13 the rotor 11 is simultaneously caused to roll on the inner toothing 15 of the housing 1 and on the gear 10 to transmit rotation to the shaft 9. From the other half of the variable volume chambers 13 the used fluid flows through the same passages 18, 19 and 20 and ports 17 communicating with the ports 29 of the control valve 25 and along the passages 30 to the hole 6 of the cover plate 3 for discharge.

For reversing the rotation of the hydraulic motor the solenoid 51 is deenergized and solenoid 52 is energized, whereby the cavity 46 communicates with the cavity 44, whereas the cavity 48 communicates with cavity 45.

The working fluid is thus caused to flow to the piston space 40 and the toothed rack 33 moves in the opposite direction until it is in contact with the stop 50. The control valve 25 turns in the opposite direction at an angle $\not\equiv=2\pi/n$ to reverse the rotation of the shaft.

During overloads, as soon as fluid pressure in the cavity 31 acting on the stop element 59 exceeds the force of the spring 60, the stop element 59 overcomes the force of the spring 60 to press it and move to the right thus communicating the passage 58, hole 55 and passages 56 and 57 with the hole 6 in the cover plate 3, whereby a pressure is established in the passages 28 and interior 24 which is higher than in the cavity 31.

The control valve 25 departs from the fluid distributor 16 for the fluid entering the ports 27 of the control valve 25 to flow through a clearance thus formed toward the ports 29 and further through the passages 30 to the hole 6 for discharge. As the pressure of fluid in the cavity 31 decreases, or when the fluid pressure force becomes less than the force of the spring 60, the stop element 59 closes the passage 58 to result in equalization of pressure in the cavity 31, interior 24 and passages 28. Under the action of springs 26 the control valve 25 is pressed to the fluid distributor 16 for the shaft 9 of the hydraulic motor to continue its rotation.

Employment of a planetary-rotor hydraulic motor embodying the present invention makes it possible to considerably simplify hydraulic system of fluid-power drives, reduce peak fluid pressures during starting, reversing and under overloads to result in improved reliability, extended service life and reduced amount of metal to be consumed for motor manufacture.

Pilot models of the planetary-rotor hydraulic motor according to the invention has been manufactured and passed bench and field tests with success. The test included their application in fluid-power drives of farm vehicles and in hydraulic drives of other machines.

What is claimed is:

1. A planetary-rotor hydraulic motor comprising: a housing, a first cover plate enclosing said housing at one of its ends; a second cover plate enclosing said housing at the other end and having a hole for feeding a fluid and a hole for discharging the fluid; an inner toothing provided on the inside of said housing; a shaft accommodated inside said housing; a gear secured on said shaft; a rotor disposed in said housing with an eccentricity relative to said shaft; an inner toothing provided in said rotor to engage with said gear; variable volume chambers defined by said gear and said inner toothing; an outer toothing made in said rotor to engage with said inner toothing of said housing; a fluid distributor secured on said shaft to adjoin by one end face said rotor; a control valve disposed in said second cover plate and capable of axial displacement, said control valve adjoining said fluid distributor, passages being provided in said fluid distributor and communicable with said holes in said second cover plate for feeding the fluid to and discharging it from the hydraulic motor and with said passages provided in said fluid distributor to deliver the fluid to and evacuate it from said variable volume chambers, said control valve and said second cover plate defining a cavity; a damping passage continuously communicating said cavity with said hole for feeding the fluid provided in said cover plate; a reversing mechanism for adjustably turning said control valve relative to said second cover plate to reverse the rotation of said shaft comprising a toothed rack, a bore made in said second cover plate to receive said toothed rack, pistons secured at the ends of said toothed rack, said pistons defining piston spaces in said bore, a toothed sector provided on said control valve and engageable with said toothed rack, a solenoid-controlled fluid distributor secured on said second cover plate and continuosly communicating with said cavity between said control valve and said second cover plate for periodically connecting said cavity with said piston spaces to adjust said toothed rack and turn said control valve relative to said second cover plate, said fluid distributor communicating in its neutral position with said hole for discharging the fluid provided in said second cover plate.

2. A planetary-rotor hydraulic motor as defined in claim 1, in which said second cover plate is provided with a passage communicating said cavity between said control valve and said second cover plate with said hole for discharging the fluid, a non-return valve being provided in this passage openable in response to an increase in the pressure of fluid in the cavity between said control valve and the second cover plate.

* * * * *